United States Patent [19]

Warner et al.

[11] 4,335,671

[45] Jun. 22, 1982

[54] FLAP LEADING EDGE FOR HYDROFOIL VESSELS AND THE LIKE

[75] Inventors: Gary J. Warner, Issaquah; Kenneth R. Meldahl, Bellevue, both of Wash.

[73] Assignee: The Boeing Company, Seattle, Wash.

[21] Appl. No.: 169,732

[22] Filed: Jul. 17, 1980

[51] Int. Cl.[3] ..... B63B 1/24; B64C 9/30

[52] U.S. Cl. ..... 114/274; 114/278; 114/280; 244/213; 244/215

[58] Field of Search ..... 114/274–282, 114/332, 126–143; 244/131, 213, 215, 211, 212, 216; 49/388

[56] References Cited

U.S. PATENT DOCUMENTS

| | | | |
|---|---|---|---|
| 2,444,293 | 6/1948 | Holt | 244/216 |
| 3,140,066 | 7/1964 | Sutton et al. | 244/215 |
| 4,213,587 | 7/1980 | Roeseler et al. | 244/213 |

FOREIGN PATENT DOCUMENTS

| | | | |
|---|---|---|---|
| 607921 | 11/1960 | Canada | 114/126 |

*Primary Examiner*—Trygve M. Blix
*Assistant Examiner*—Thomas J. Brahan
*Attorney, Agent, or Firm*—Hughes, Barnard & Cassidy

[57] ABSTRACT

An improved leading edge contour for control flaps of the type suitable for use with hydrofoil vessels and the like wherein discontinuities or gaps between the leading edge of the flap and the trailing edge of the fluid foil to which it is attached are held to a minimum; yet, wherein localized or discontinuous differential deflection of the flap leading edge and the foil trailing edge, which inherently occurs as the vessel moves through a fluid medium, does not result in interference between the two edges, thereby minimizing the problem of reduced fatigue life; and, wherein excessively large discontinuities are not required between the two edges in those edge areas where no significant differential deflection occurs, thereby significantly improving the performance characteristics of both the flap and the flap/foil combination. More specifically, an improved flap leading edge construction wherein the distance between the flap leading edge and the foil trailing edge is maintained at a desired minimum, or optimized, gap space in those regions where the flap leading edge is positively, yet hingedly, connected to the foil trailing edge—i.e., those points of "hard" connection—while that region of the flap leading edge intermediate such hinged "hard" connection points—i.e., regions of "soft" or non-positive connection—define a slightly greater gap or discontinuity with the foil trailing edge, thereby permitting greater differential deflection of the two edges in those regions of "soft" or non-positive connection where the flap is generally subjected to deflection of greater magnitude than is the foil; yet wherein the foil trailing edge can be simply machined as a radius at constant percent of chord over the entire span of the foil.

11 Claims, 9 Drawing Figures

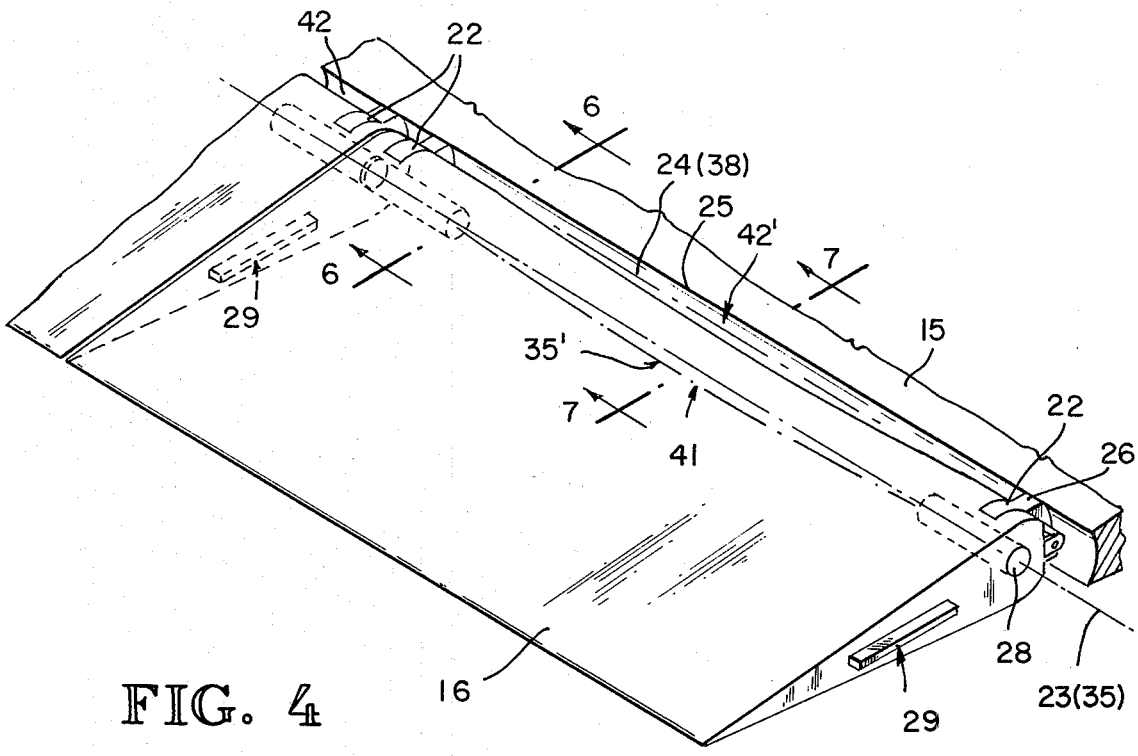
FIG. 4
FIG. 5
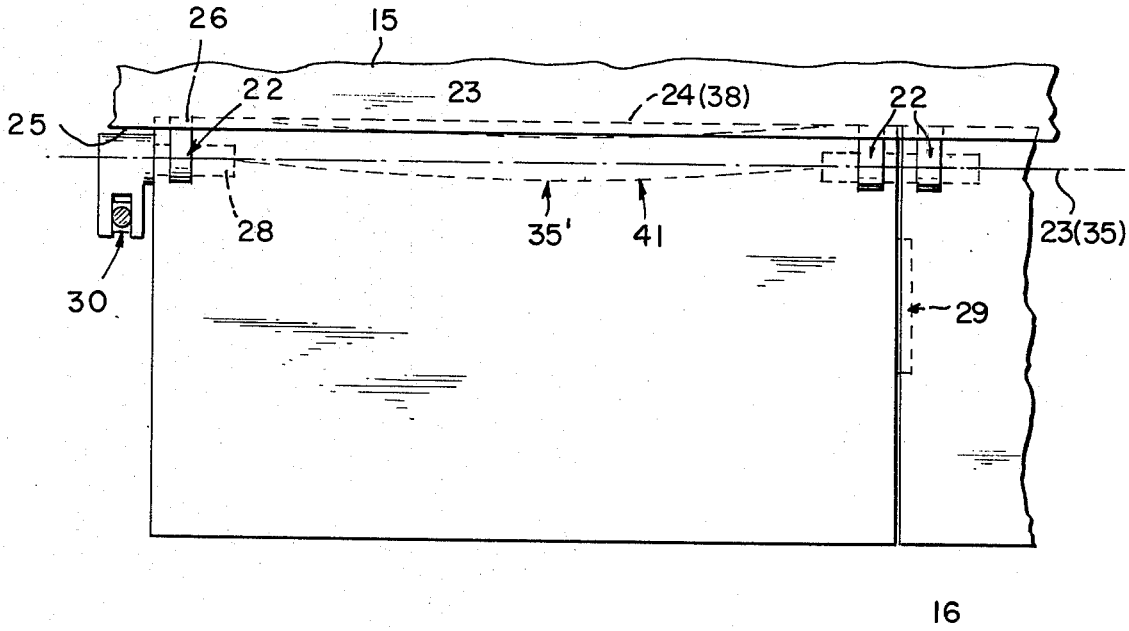

FLAP LEADING EDGE FOR HYDROFOIL VESSELS AND THE LIKE

BACKGROUND OF THE INVENTION

The present invention relates in general to flaps such, for example, as control flaps of the type which are conventionally hingedly connected to the trailing edge of a stationary foil on a vessel—e.g., a hydrofoil vessel or the like—and, more particularly, to an improved flap construction which permits optimization of the discontinuity or gap required between the flap leading edge and the foil trailing edge at all points along the entire span of the foil irrespective of the fact that in those specific areas where the flap is hingedly connected to the foil, a "hard" connection is formed and, consequently, little, if any, differential deflection occurs; yet, wherein those regions of the flap intermediate adjacent points of "hard" hinged connection—i.e., those regions intermediate "hard" points spaced apart in a span-wise direction—permit of maximized differential deflection between the two edges resulting from the pressure of the fluid medium through which the flap/foil combination is moving without any possibility of interference between the flap and the foil.

Although the present invention finds particularly advantageous use in connection with flap/foil combinations as used on hydrofoil vessels and the like and will, therefore, be described in such an environment, those skilled in the art will readily appreciate as the ensuing description proceeds that the invention is not so limited and may find advantageous application in other environments such, for example, as control flaps on the trailing edges of airfoils used with aircraft.

It has long been recognized that trailing edge flaps for vessel control—particularly, for control of hydrofoil ships—are desirable and, indeed, often essential in order to permit reliable controlled maneuverability of the vessel; and, consequently, it has been a common practice to hingedly connect a plurality of such trailing edge flaps to the trailing edge of a foil with the leading edge of the flaps spaced from, but in close proximity to, the trailing edge of the foil. In such arrangements, it is also generally common for adjacent flaps to be interconnected in end-to-end fashion with each flap serving to drive at least one adjacent flap and with each flap (except for that flap or those flaps directly connected to external drive mechanisms) being driven by an adjacent flap. However, regardless of whether any given flap is functioning as a drive flap, a driven flap, or both, its leading edge is generally hingedly connected to the foil trailing edge at two points spaced apart in a span-wise direction; and, at those points of hinged connection, the flap leading edge and foil trailing edge will generally be deflected in like amounts and in unison by the pressure of the fluid through which the vessel is moving. Consequently, in these localized spaced regions of "hard" connection, it is theoretically possible and relatively simple to design mating edge contours which ensure maintenance of optimized gaps or discontinuities therebetween at all times and under all operating conditions.

Unfortunately, however, in those regions of the mating flap leading edge and foil trailing edge which are located between the span-wise spaced hinged points of "hard" connection, dynamic conditions are such that in operation the pressure of the fluid medium through which the vessel is passing serves to cause significant deflection of both the foil (and its trailing edge) and the flap (and its leading edge). While the degree of deflection between such foil trailing edge and flap leading edge is substantially the same at the spaced "hard" points of hinged connection therebetween, in the "soft" regions intermediate such spaced "hard" points the degree of deflection between the two edges can be, and often is, significantly different.

Indeed, when dealing with a foil having a free tip that is not directly and positively connected to the vessel structure, the relative deflections of the flap leading edge and the foil trailing edge can be in opposite directions. For example, assuming that the vessel is a hydrofoil ship moving through water and that the trailing edge control flap(s) is(are) shifted through a downward or negative angle of rotation for the purpose of improving lift and/or controlling maneuverability, those skilled in the art will appreciate that fluid pressure applied to the bottom surfaces of the flap/foil combination will cause the outer tip of the foil to be deflected upwardly to a greater extent than inboard regions thereof, thus producing a foil trailing edge contour that is slightly concave rather than linear. Considering any given flap having its leading edge hingedly connected to such concave foil trailing edge at two spaced span-wise points, it will be appreciated that at the two points of "hard" or hinged connection, the flap leading edge will move with the foil trailing edge and, hence, at those two points the gap or discontinuity therebetween remains substantially constant. But, intermediate those two points, fluid pressure exerted by the water through which the vessel is moving will be applied directly to the under-surface of that flap, causing the flap and its leading edge to be deflected upwardly in the intermediate unconstrained region of the flap. That is, the central portion of the flap leading edge will be cambered or bowed upwardly so that the flap leading edge assumes a somewhat convex shape in the region of the concave foil trailing edge, thus causing interference between the two edges with resultant reduction in fatigue life thereof and/or significant decrease in the size of the gap or discontinuity between the flap leading edge and the foil trailing edge along the upper surface of the flap/foil combination; while, at the same time, significantly increasing the size of the gap or discontinuity between the two edges along the lower surface of the flap/foil combination. A somewhat similar result occurs even when the two edges are deflected in the same direction since the two edges tend to be deflected by different amounts, particularly at the mid-point of the flap leading edge.

The foregoing differential deflection problems have, for a long period of time, presented severe design problems for foil designers. Thus, while control flaps are desirable and, indeed, essential in many applications, the need to provide a gap or discontinuity between the flap and the foil at the juncture thereof tends to increase drag and to lessen the effectivity of the flap. The degree of degradation in flap performance has been found to be directly related to the size of the discontinuity or gap between the foil trailing edge and the flap leading edge.

Prior to the advent of the present invention, various attempts have been made to solve the problems introduced by varying discontinuities at the junction of the flap leading edge and the foil trailing edge. One such attempt has involved the use of adjustable flap hinges; an approach involving cumbersome and expensive assembly procedures requiring the use of separate shims. Unfortunately, during routine periodic maintenance there is a distinct possibility that one or more of such shims will be removed and will not be replaced or, if replaced, will be improperly positioned, thereby promoting flap/foil interference, reducing fatigue life, increasing drag, and decreasing flap effectivity. Moreover, fatigue life of the foil is further severely reduced because such adjustable hinge arrangements introduce undesired stress concentrations at localized points.

A second approach that has been employed, but which has been found to be entirely unsatisfactory, has been that of simply providing a sufficiently large gap or discontinuity at the hinged connections and, therefore, along the juncture of the flap leading edge and foil trailing edge in the span-wise space intermediate the hinged connections, that flap/foil interference is precluded even under those operating conditions when the edges are subjected to maximum differential deflection. Although this approach has eliminated the problems of reduced fatigue life, cost, and difficulties in assembly procedures, at the same time the excessively large discontinuities or gaps have further increased drag and reduced flap effectivity.

Other prior art of purely general interest to the subject of flap/foil design problems include that disclosed in, for example, U.S. Pat. No. 3,044,432 Wennagel et al.; U.S. Pat. No. Re. 26,059 Meyer et al.; U.S. Pat. No. 3,347,197 Scherer; and, U.S. Pat. No. 3,934,533 Wainwright.

SUMMARY OF THE INVENTION

Accordingly, it is a general aim of the present invention to provide an improved flap construction which, while highly simple and devoid of costly maintenance and/or assembly complexities, nevertheless is highly effective in optimizing the discontinuity between the flap leading edge and the foil trailing edge at virtually all operative positions and/or conditions and which, therefore, results in minimized drag and maximized flap effectivity even when the flap leading edge and foil trailing edge are subjected to maximum differential deflection.

Another important objective of the invention is the provision of an improved high performance flap construction for hydrofoil vessels and the like wherein the theoretical designed discontinuity between flap and foil in those regions where the flap is hingedly connected to the foil is maintained at optimized, minimized, constant gaps; yet, wherein the designed gap or discontinuity between the flap leading edge and the foil trailing edge in a flap/foil combination is gradually increased towards the mid-point of the flap leading edge from both span-wise spaced hinge connections, thereby insuring that even when the central portion of the flap is deflected to its maximum extent under dynamic operating conditions, the desired theoretical minimum or optimized gap still exists between the mid-point of the flap leading edge and the foil trailing edge, thereby precluding the possibility of flap/foil interference and minimizing the risk of fatigue failure.

An ancillary object of the invention is the provision of an improved high performance flap construction which permits attainment of the foregoing objectives, yet wherein the trailing edge of the foil can be simply machined as a radius at constant percent of chord over the entire span of the foil.

A more detailed object of the invention is to provide a flap/foil interface or juncture wherein a minimum optimized discontinuity can be positively maintained under virtually all operating conditions along the entire span-wise extent of the foil trailing edge and each flap's leading edge, yet which does not require (i) any separate shims or similar adjustable components or (ii) any special installation and/or maintenance procedures, and which can be used in virtually any flap/foil combination, including those commonly used with hydrofoil vessels, while employing hinges and/or drive arrangements that are completely conventional in all respects.

DESCRIPTION OF THE DRAWINGS

These and other objects and advantages of the present invention will become more readily apparent upon reading the following detailed description and upon reference to the attached drawings, in which:

FIG. 4 is an enlarged perspective view of an exemplary flap embodying features of the present invention, here illustrating in diagrammatic fragmentary form exemplary means for hingedly connecting such flaps to the trailing edge of the foil and the means by which adjacent flaps are interconnected in end-to-end relation;

FIG. 5 is a plan view of a flap made in accordance with the present invention here illustrating, in highly exaggerated diagrammatic form, the improved leading edge contour of the flap which permits attainment of the objectives of the invention;

Figure 1:
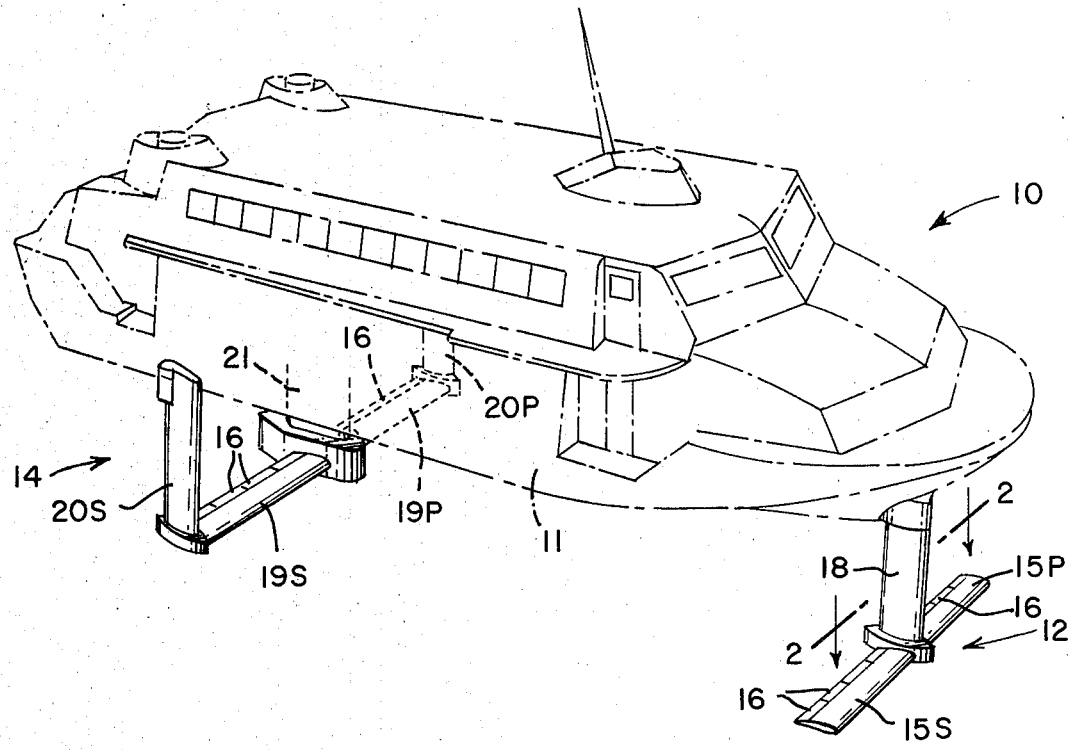
FIG. 1 is a highly diagrammatic, perspective view of a typical conventional hydrofoil ship which is here illustrated as including a pair of hydrofoils, there being one hydrofoil mounted on a central support pillar beneath the bow of the vessel and a second hydrofoil mounted on three vertical pillars beneath the stern of the vessel.

While the invention is susceptible of various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as expressed in the appended claims.

DETAILED DESCRIPTION

Turning first to FIG. 1, an exemplary conventional hydrofoil vessel, generally indicated in phantom at 10, has been illustrated; such vessel having a hull 11 and a pair of hydrofoils, generally indicated at 12 and 14, respectively mounted beneath the bow and the stern of the vessel. As here shown, the bow-mounted hydrofoil 12 comprises a pair of horizontally extending, laterally projecting foils 15P and 15S which are identical in all respects and which are each provided with a plurality of control flaps 16 mounted along the trailing edge of the foil. The port and starboard foils, 15P and 15S respectively, are supported at the inboard ends thereof by a vertically extending pillar 18 which is rigidly secured to the keel of the ship 10 beneath the bow thereof and which serves to house suitable actuating mechanisms (not shown) for activating the trailing edge flaps in a conventional manner.

The stern-mounted hydrofoil 14 also comprises a pair of horizontal, laterally extending port and starboard foils 19P, 19S, respectively, each of which has secured thereto a plurality of trailing edge flaps 16 which may be identical to the flaps used with the bow-mounted foils 15P, 15S. In this case, however, the increased beam of the vessel beneath the stern permits the outboard ends of the foils 19P, 19S to be supported by a pair of vertically extending outboard pillars 20P, 20S rigidly secured to the hull of the vessel 10, while the inboard ends of the foils 19P, 19S are supported by a third vertical pillar 21 rigidly secured to the hull of the vessel 10 beneath the keel thereof. As with the bow-mounted hydrofoil 12, the flaps 16 on the stern-mounted hydrofoil 14 can be actuated in any conventional manner by means of actuating linkages (not shown) contained within one or more of the vertical pillars 20P, 20S and 21.

Figure 2:
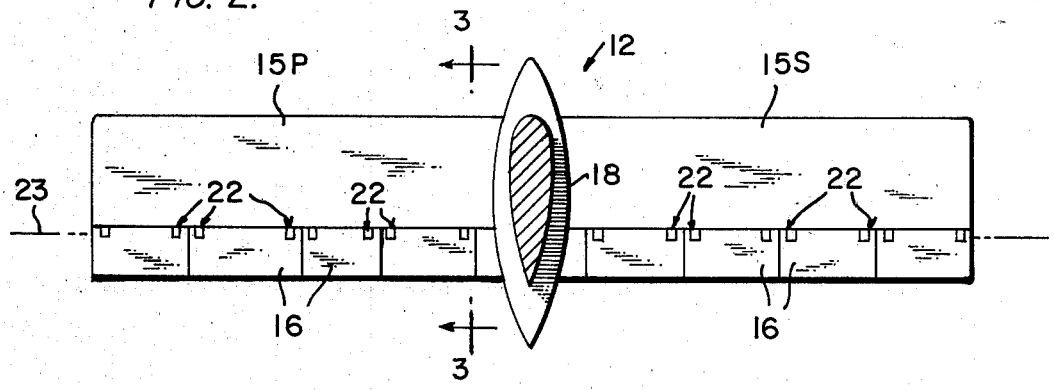
FIG. 2 is a plan view of the bow-mounted foil shown in FIG. 1, here taken substantially along the line 2—2 in FIG. 1.
Figure 3:
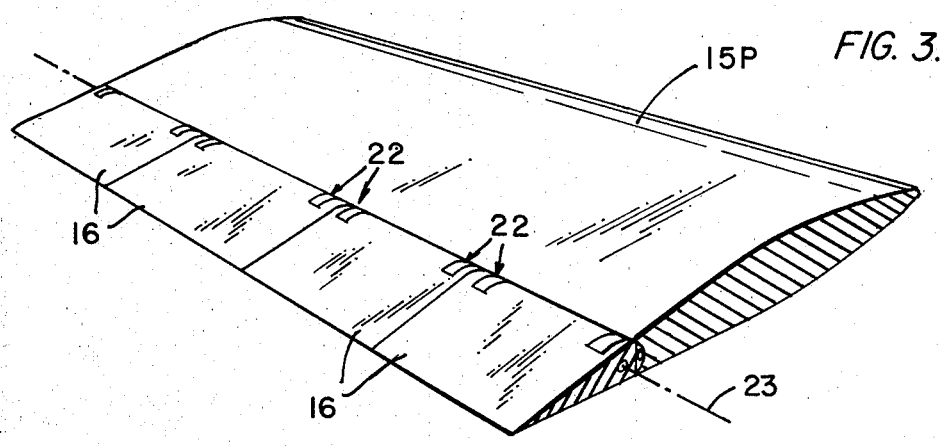
FIG. 3 is a perspective view, partly in section taken substantially along the line 3—3 in FIG. 2, here illustrating the relationship of the bow-mounted foil and the plurality of trailing edge control flaps mounted thereon.

Referring to FIGS. 2 and 3 conjointly, it will be noted that the flaps 16 are each hingedly connected along their leading edges to the trailing edge of one of the bow mounted foils 15P, 15S, as generally indicated at 22, so as to permit controlled angular rotation about an axis of rotation 23. Thus, as shown in somewhat greater detail in FIGS. 4 and 5, it will be observed that the leading edge 24 of each flap 16 is hinged directly to the trailing edge 25 of the foil 15 by means of a pair of socket-type hinge elements 26 rigidly secured to the trailing edge 25 of the foil 15 and within which are received ball type or, as here shown, rod-like pivot shafts 28 which are fixedly secured within the flap and extend longitudinally along the leading edge thereof adjacent the inboard and outboard extremities of the flap. Although each flap is illustrated in FIG. 4 as including a pair of hinged connections 22 at the juncture between the leading edge 24 of the flap and the trailing edge 25 of the foil, those skilled in the art will readily understand that only one such hinged connection is essential since the pivot shaft 28 can be designed as shown in FIG. 5 to extend laterally into one end of the adjacent flap so that a single hinged connection 22 provides pivotal support for two adjacent flaps.

In order to permit controlled movement of the flaps up and down in unison, adjacent flaps 16 may be interconnected in end-to-end fashion along the span-wise trailing edge 25 of the foil 15 by means of a suitable tongue and groove arrangement, generally indicated at 29 in FIGS. 4 and 5. Thus, as any given flap 16 is moved downwardly through a desired negative rotational angle about the axis of rotation 23 defined by its pivot shaft or shafts 28, the tongue and groove arrangement 29 between adjacent flaps serves to transmit such rotational movement to the adjacent flap. To impart such rotational movement in either a negative downward direction or in a positive upward direction, at least one flap 16 is coupled to any suitable drive means such as that generally indicated at 30 in FIG. 5.

Figure 8:
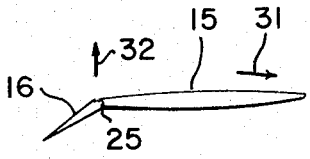
FIG. 8 is a highly diagrammatic view of a typical flap/foil combination with the flap shown in its downward rotated position and indicating generally the fluid forces to which the flap is subjected as the vessel moves through a fluid medium; and, FIG. 9 is a highly diagrammatic view generally illustrating the deflected contour of a foil of the type supported from a vessel only at the mid-point of the foil as the foil and vessel move through a fluid medium and, illustrating also, the compression areas that are produced by such deflection.

Referring next to FIG. 8, it will be appreciated that as a hydrofoil moves through the water in the direction of the arrow 31, and assuming that the trailing edge flap 16 is rotated downwardly into the position illustrated, the pressure exerted by the water through which the foil 15 and flap 16 are moving interacts with the under surfaces of the flap/foil combination so as to produce an upwardly directed force as indicated by the arrow 32. It is this force which tends to cause the flap 16 to be deflected and, because the flap is constrained from deflection relative to the foil trailing edge 25 at the points of hinged connection thereto, such a force actually causes the leading edge of the flap to be cambered or bowed upwardly into a somewhat convex shape with the maximum degree of deflection being generally located at the mid-point of the flap 16 between its two points of hinged connection 22 (FIGS. 2–5) to the foil 15.

Figure 9:
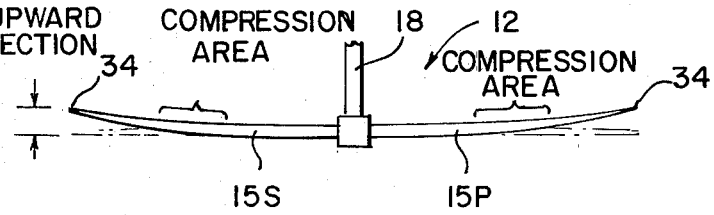

Similarly, and as best illustrated by reference to FIG. 9, it will be observed that where the hydrofoil 12 comprises a pair of laterally extending foils 15P and 15S (such, for example, as the arrangement depicted with the bow-mounted hydrofoil 12 in FIG. 1) which are supported only by a centrally located pillar 18 at the inboard ends of the foils 15P, 15S, movement of the vessel through a fluid medium causes the outer extremities of the foils 15P, 15S to be deflected, generally in a direction opposite to that of the angular position of the flaps. That is, where the flaps are rotated through a negative angle to provide lift in the manner shown in FIG. 8, fluid pressure on the under-surface of the foils and the flaps tends to cause the unsupported free tips 34 of the foils to deflect upwardly, thereby producing a series of compression areas along the span-wise extent of each foil and causing the trailing edge of each foil to assume a somewhat concave configuration. Conversely, where the flaps 16 are pivoted in an upward direction—i.e., through a positive rotational angle (not shown)—the fluid through which the vessel is moving tends to impinge upon the upper surface of the flap and the resultant force applied tends to cause the outer tips 34 of the foils to deflect downwardly. Indeed, similar results, although lesser in degree, occur at the mid-points of foils which are supported at two spaced locations such, for example, as the foils 19P and 19S associated with the stern-mounted hydrofoil 14 depicted in FIG. 1.

Figure 6:
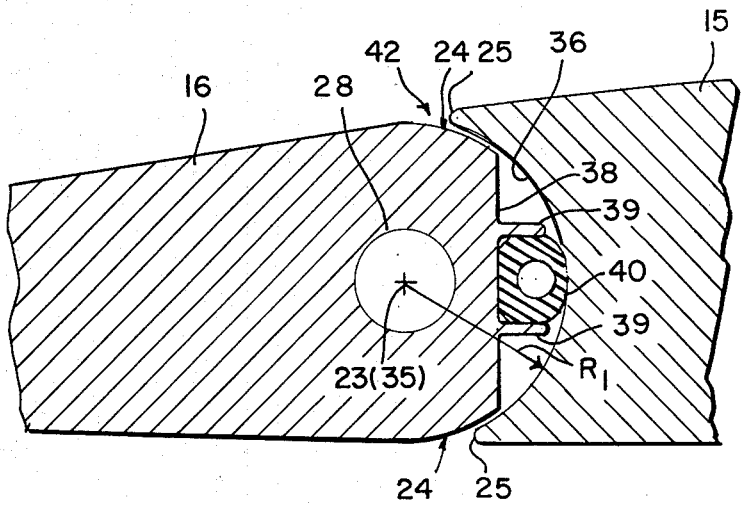
FIG. 6 is a fragmentary sectional view taken substantially along the line 6—6 in FIG. 4 and here illustrating the discontinuity maintained between the foil trailing edge and the flap leading edge in the region immediately adjacent to a point of "hard" hinged connection between the flap and the foil.

In accordance with one of the important aspects of the present invention, provision is made for ensuring that an optimized minimum gap or discontinuity is maintained along the entire span-wise length of a foil 15 between the trailing edge 25 of the foil and the leading edges 24 of the control flaps 16 mounted thereon at virtually all operating conditions and flap positions irrespective of differential deflection that is inherently produced at the juncture between the foil trailing edge 24 and the leading edges 25 of the flaps 16 when the flaps are rotated out of the plane of the foil during movement of the flap/foil combination through a fluid medium such, for example, as movement of a hydrofoil having trailing edge flaps through water; yet, wherein flap/foil interference and resulting reduction in fatigue life is precluded, drag is decreased, and flap efficiency is increased. To accomplish this, and as best illustrated by reference to FIGS. 4–7 conjointly, it will be observed that the leading edge 24 of each flap 16 is preferably formed with a generally rounded radius of curvature $R_1$ circumscribed about a centerline 35, which is, at least in part, coincident with the axis of rotation 23; thereby permitting the leading edge of each flap 16 to be received within a rounded concavity 36 formed in the trailing edge 25 of the foil 15. As illustrated in greater detail in FIG. 6, the rounded leading edge 24 includes a vertical flat 38 and a pair of integral, vertically spaced, forwardly projecting seal-retaining lips 39 adapted to receive a flexible wiping seal 40 positioned for wiping contact with the concave surface 36 formed in the foil trailing edge 25. Preferably, the arrangement is such that the concave surface 36 in the trailing edge 25 is machined or otherwise formed as a radius at constant percent of chord over the entire span of the foil 15, centered on the aforementioned axis of rotation 23.

In carrying out the present invention, the rounded portions of the leading edge 24 on each flap 16 are formed with a radius of curvature $R_1$ preferably also comprising a radius at a constant percent of chord over the entire span of the flap and also centered on the aforementioned axis of rotation 23; but, in accordance with the invention, the center points 35 are here defined by a curvilinear span-wise centerline about which the radius of curvature for the flap leading edge 24 is circumscribed and which is drifted slightly towards the rear of the flap at increasing distances from the inboard and outboard edges of the flap, as generally indicated at 41 in FIGS. 4 and 5. Thus, referring to FIG. 6 (a sectional view taken in close proximity to a hinged connection 22 between the flap 16 and foil 15—i.e., a "hard" connection point), it will be appreciated that in this region of the flap/foil juncture there is little tendency for the leading edge 24 of the flap 16 and the trailing edge 25 of the foil 15 to be subjected to differential deflection as a result of fluid forces imposed thereon as the flap/foil combination moves through a fluid medium such, for example, as water. Consequently, the gap or discontinuity, generally indicated at 42, between the two edges remains substantially constant in these localized regions irrespective of the degree or direction of angular rotation of the flap 16. On the other hand, the central portion of the flap 16 is not hinged directly to the foil 15 and, consequently, fluid forces do tend to cause differential deflection between the central portion of the flap leading edge 24 and the foil trailing edge 25; which differential deflection, in the absence of the present invention, tends to cause flap/foil interference with resulting reduced fatigue life.

Figure 7:
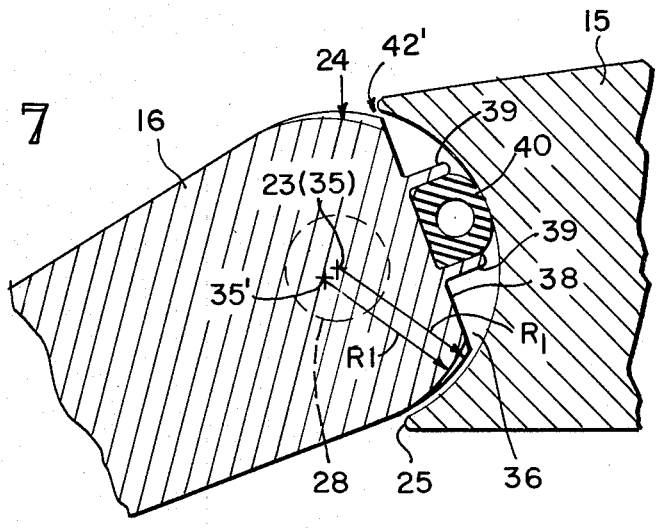
FIG. 7 is a fragmentary sectional view somewhat similar to FIG. 6, but here taken substantially along the line 7—7 in FIG. 4 at the mid-point of the flap, but illustrating the flap in a downwardly rotated angular position under static pressure conditions—i.e., the unconstrained central portion of the flap has not been deflected by fluid pressure.

However, with the present invention, such problems are obviated since the centerline about which the radius of curvature is circumscribed comprises a curvilinear centerline which is gradually drifted rearwardly from the points 35 coincident with the axis of rotation 23 (FIGS. 6 and 7) to the point 35' (FIG. 7) as one moves toward the central unconstrained portions of the flap 16, thus causing the gap 42 between the leading edge 24 of the flap 16 and the trailing edge 25 of the foil 15 to gradually increase towards the central portions of the flap (as indicated generally at 42' in FIGS. 4 and 7). That is, the centerline defined by the points 35, 35' is drifted rearwardly relative to the axis of rotation 23 in those regions of the flap intermediate two adjacent span-wise spaced hinge connections 22. Since it is the central portion of the flap 16 that is subjected to maximum amounts of deflection induced by fluid pressure during dynamic operating conditions, the slightly increased gap 42' in these regions permits such deflection to occur without interference between the flap 16 and the foil 15, thereby significantly reducing the risk of fatigue failure.

Those skilled in the art will appreciate that the extent of rearward drift of the curvilinear centerline of the radius of curvature $R_1$ for the flap's leading edge contour—i.e., from a point 35 in proximity to a relatively "hard" hinged connection 22 to a point 35' approximately midway between two adjacent hinged connections 22—may vary considerably dependent upon a wide range of design parameters such, for example, as: the length and thickness of the flap leading edge; the surface area of the flaps; the materials from which the flap and foil are formed; the distance between adjacent points of hinged contact; the nature of the fluid medium through which the foil is moving (i.e., water or air); the speed at which the vessel is designed to move through such medium; and, the range of rotational angles through which the flap 16 is intended to be activated; since, all of the foregoing have a direct bearing upon the degree of differential deflection that the foil and the unconstrained central portion of the flap will be subjected to under normal operating conditions.

Thus, assuming, for example, that an optimized minimum theoretical gap is x millimeters for a given flap/foil combination and, assuming further, that the normal expected dynamic operating conditions are such that maximum relative deflection between the flap leading edge 24 and the foil trailing edge 25 is anticipated to range from about zero at a point of "hard" hinged connection 22 adjacent the inboard and outboard ends of the flap 16 to about y millimeters at the central portion of the flap, then the distance between the points 35 and 35'—i.e., the degree of drift of the centerline defined by such points—is preferably selected such that even when the central portion of the flap is deflected by y millimeters, the gap between the central portion of the deflected flap leading edge 24 and the foil trailing edge 25 at that point of maximum differential deflection—i.e., at the mid-point of the span-wise distance between two adjacent hinged connections 22—is at least x millimeters. For example, we have found that when dealing with hydrofoil vessels of the type having flaps 16 on the order of 1.0 meters in span-wise length, approximately 0.5 meters from the flap leading edge to the flap trailing edge, and approximately 100 millimeters in maximum thickness adjacent the leading edge 24, generally satisfactory results can be obtained when the distance between parallel lines passing through the centerline points 35 and 35' at the point of expected maximum flap deflection—i.e., at the span-wise point midway between adjacent hinged connections 22—is on the order of 4.0 millimeters. That is to say, as one moves along the leading edge 24 of a flap 16 from the inboard and outboard extremities of the flap towards the central portion thereof, the leading edge contour as viewed in plan gradually drifts rearwardly relative to the axis of rotation 23 and the flap trailing edge, with the maximum drift being located at the mid-point of the span-wise distance between adjacent points of hinged connection 22 and being on the order of 4.0 millimeters.

Keeping the foregoing exemplary dimensional considerations in mind—viz, in the case of a flap 16 having a leading edge thickness on the order of 100 millimeters (i.e., a radius of curvature $R_1$ on the order of 50 millimeters) which is drifted back at its central unconstrained regions by only on the order of 4.0 millimeters—it will be appreciated that the optimized theoretical foil-to-flap contour line is not significantly affected by the present invention; this despite the fact that the degree of drift is sufficient to preclude flap/foil interference. Stated differently, and as best illustrated by reference to FIGS. 4–6 conjointly, the flap leading edge 24 is contoured in such a manner that it fairs with the theoretical foil contour directly above and below the axis of rotation 23. However, forward of the axis of rotation 23, the flap leading edge 24 fairs inward in such a way as to provide the clearances necessary to accommodate: (i) manufacturing machining tolerances; (ii) manufacturing welding distortions; (iii) manufacturing heat treatment distortions; and (iv), in-flight deflection. Yet, such fairing is done with a very gradual blend so that, even when the flap 16 is fully rotated, the foil-to-flap contour line is only very slightly affected. Nevertheless, the present invention ensures the necessary clearance even when the flap 16 and foil 15 are subjected to maximum in-flight deflection—i.e., when the flap is fully rotated.

Of course, while the present invention has herein been described in connection with an exemplary embodiment in which the flap 16 is formed with a "rounded" leading edge 24 defined by a "radius of curvature $R_1$" circumscribed about a curvilinear centerline defined by point 35, 35', those skilled in the art will appreciate that the flap leading edge 24 could have other cross-sectional configurations such, for example, as parabolic, ellipsoidal, polygonal and/or truncated forms of such configurations. Therefore, the terms and phrases "rounded" and/or "radius of curvature $R_1$" as used herein and in the appended claims to describe the shape of the flap leading edge 24 have been used in their exemplary sense and not in a limiting sense.

Thus, those skilled in the art will appreciate that an improved high performance flap has herein been described which permits the leading edge contour of each flap 16 to be shaped in such a manner that an optimized minimum theoretical gap size can be selected for any given flap/foil combination, with such gap being actually formed at the flap/foil juncture only in those regions in close proximity to a "hard" hinged connection 22 where the flap 16 and foil 15 are not subjected to differential deflection under dynamic operating conditions; whereas, in those regions of the flap intermediate the points of "hard" connection where the leading flap edge 24 is not constrained against deflection relative to the foil trailing edge 25 when the flap 16 is rotated out of the plane of the foil 15, the leading edge 24 is gradually drifted back (i.e., is slightly concave when viewed in plan as best shown in FIGS. 4 and 5) so as to gradually increase the size of the gap or discontinuity as one moves towards the mid-point between adjacent hinged connections 22, and so that when the flap 16 is rotated out of the plane of the foil 15 and the two adjacent flap and foil edges 24, 25 are subjected to differential deflection, the deflected central portion of the flap 16 tends to move into the larger region of discontinuity and thereby maintain the actual gap or discontinuity between the two edges generally uniform and generally at the optimized minimum theoretical gap size designed across the entire span of the flap's leading edge 24.

What is claimed is:

1. An improved high performance fluid foil having a plurality of trailing edge control flaps mounted thereon, said foil having a trailing edge machined as a radius at constant percent of chord over the entire span of said foil, a plurality of control flaps each having a leading edge and a trailing edge, a plurality of pairs of span-wise spaced hinge means for connecting said leading edge of each of said plurality of flaps to said foil trailing edge with said flap leading edges and said foil trailing edge being spaced apart by a gap extending the entire span-wise extent of each of said flaps, said flap leading edges each being contoured so that said gap is greater at the mid-point between said span-wise spaced hinge means than in the region of said hinge means when said flaps are in an undeflected state so that upon controlled angular rotation of said flaps out of the plane of said foil, the central portions of said flaps have freedom for fluid induced deflection relative to said foil trailing edge at the mid-points between said span-wise spaced points of hinged connection without interference between said flap leading edges and said foil trailing edge.

2. An improved high performance fluid foil as set forth in claim 1 wherein said flap leading edges (i) fair with the theoretical foil contour directly above and below the centerline passing through said span-wise spaced hinge means and (ii) gradually fair inward forward of said hinge means centerline so as to provide sufficient clearance between said flap leading edges and said foil trailing edges as to preclude interference therebetween upon fluid induced deflection of the unconstrained central portions of said flaps at all operative flap positions.

3. An improved high performance fluid foil as set forth in claim 1 wherein each of said contoured flap leading edges comprises a rounded edge having a radius of curvature $R_1$ circumscribed about a curvilinear span-wise centerline passing through said flap.

4. An improved high performance fluid foil as set forth in claim 3 wherein each of said curvilinear span-wise centerlines is drifted back in the central portions of each of said flaps intermediate said pairs of span-wise spaced hinge connections and relative to the axis of rotation passing therethrough.

5. An improved high performance fluid foil as set forth in claim 3 wherein said curvilinear span-wise centerline is coincident with the axis of rotation passing through said span-wise spaced hinge means only in those span-wise regions of said hinge means.

6. An improved high performance fluid foil as set forth in claim 4 wherein said curvilinear span-wise centerline is coincident with the axis of rotation passing through said span-wise spaced hinge means in the regions of said hinge means and is spaced rearwardly from said axis of rotation intermediate said span-wise spaced hinge means.

7. An improved high performance fluid foil as set forth in claim 1, 2, 3, 4, 5 or 6 wherein said fluid foil is a hydrofoil.

8. An improved high performance fluid foil as set forth in claim 1, 2, 3, 4, 5 or 6 wherein said fluid foil is a hydrofoil, said flaps are each on the order of (i) 1.0 meters in span-wise length, (ii) 0.5 meters in chordal extent, and (iii) 100 millimeters in thickness adjacent said flap leading edge, and said contoured leading edge is shaped so that said gap is on the order of 4.0 millimeters greater in width at the mid-point between said span-wise spaced hinge means than in the regions of said span-wise spaced hinge means.

9. An improved high performance control flap having leading and trailing edges and suitable for mounting on the trailing edge of a fluid foil with freedom for controlled angular rotation about an axis of rotation passing through a pair of span-wise spaced hinge connections between the foil trailing edge and said flap leading edge so as to permit controlled angular rotational movement of said flap into and out of the plane of the foil whereby the central portion of said flap intermediate the span-wise spaced hinge connections is subjected to deflection relative to the foil trailing edge resulting from imposed fluid forces, said control flap having a rounded leading edge with a radius of curvature $R_1$ circumscribed about a curvilinear centerline extending along the span-wise length of said flap, said curvilinear centerline being gradually drifted back relative to said axis of rotation and towards said trailing edge of said flap in the central portion of said flap intermediate said span-wise spaced hinge connections so that when said flap is hingedly connected to the fluid foil a gap exists between said flap leading edge and the foil trailing edge with such gap being greater at the mid-point between said span-wise spaced hinged connections than at said connections when said flap is in the undeflected state.

10. An improved high performance control flap as set forth in claim 9 wherein said flap is adapted to be hingedly connected to a hydrofoil and the unconstrained flap leading edge intermediant adjacent span-wise spaced hinge connections is subjected to deflection resulting from water pressure as the hydrofoil moves through the water.

11. An improved high performance control flap as set forth in claim 9 or 10 wherein said curvilinear centerline is drifted back relative to said axis of rotation by a distance on the order of 4.0 millimeters greater at the mid-point between said span-wise spaced connections than at said connections.

* * * * *